United States Patent [19]

Novotny et al.

[11] 4,443,957

[45] Apr. 24, 1984

[54] SNUBBER HAVING UNITARY ELASTIC BODY

[75] Inventors: Raymond J. Novotny, Sparta; Henry J. Ihlein, Ringwood, both of N.J.

[73] Assignee: Abex Corporation, New York, N.Y.

[21] Appl. No.: 350,942

[22] Filed: Feb. 22, 1982

[51] Int. Cl.[3] ..... E02F 3/46

[52] U.S. Cl. ..... 37/118 R; 267/153; 414/722; 294/69 R

[58] Field of Search ..... 37/118 R, 118 A; 414/704–709, 722, 723, 720; 267/153, 134; 294/69 R, 69 A; 16/85, 86 R; 198/704, 713

[56] References Cited

U.S. PATENT DOCUMENTS

| | | | |
|---|---|---|---|
| 146,325 | 1/1874 | Eaton . | |
| 2,160,432 | 5/1939 | Davidson | 214/146 |
| 2,434,902 | 1/1948 | Burdick | 214/146 |
| 2,561,518 | 7/1951 | Larsen | 37/118 R |
| 2,604,221 | 7/1952 | Edwards et al. | 214/146 |
| 2,641,792 | 6/1953 | Peeler | 16/86 |
| 2,735,559 | 2/1956 | Burdick et al. | 37/118 R |
| 2,840,253 | 6/1958 | Thompson | 214/146 |
| 3,583,693 | 6/1971 | Johnston | 267/153 |
| 3,795,392 | 3/1974 | Nemec | 267/153 |
| 3,892,398 | 7/1975 | Marsh | 267/153 |
| 3,901,495 | 8/1975 | Suzuki | 267/153 |
| 4,006,832 | 2/1977 | Auxer et al. | 214/146 |
| 4,063,373 | 12/1977 | Greer et al. | 414/722 |

*Primary Examiner*—E. H. Eickholt

*Attorney, Agent, or Firm*—Thomas S. Baker, Jr.

[57] ABSTRACT

A unitary urethane snubber is provided to snub opening and closing movements of a dipper door. The snubber has an elongated working section that is stretched to snub door closing and bent to snub door opening. A pair of integral end lugs pivotally attach the snubber to the dipper and to the door. The snubber is unstressed in an intermediate position to facilitate installation.

5 Claims, 8 Drawing Figures

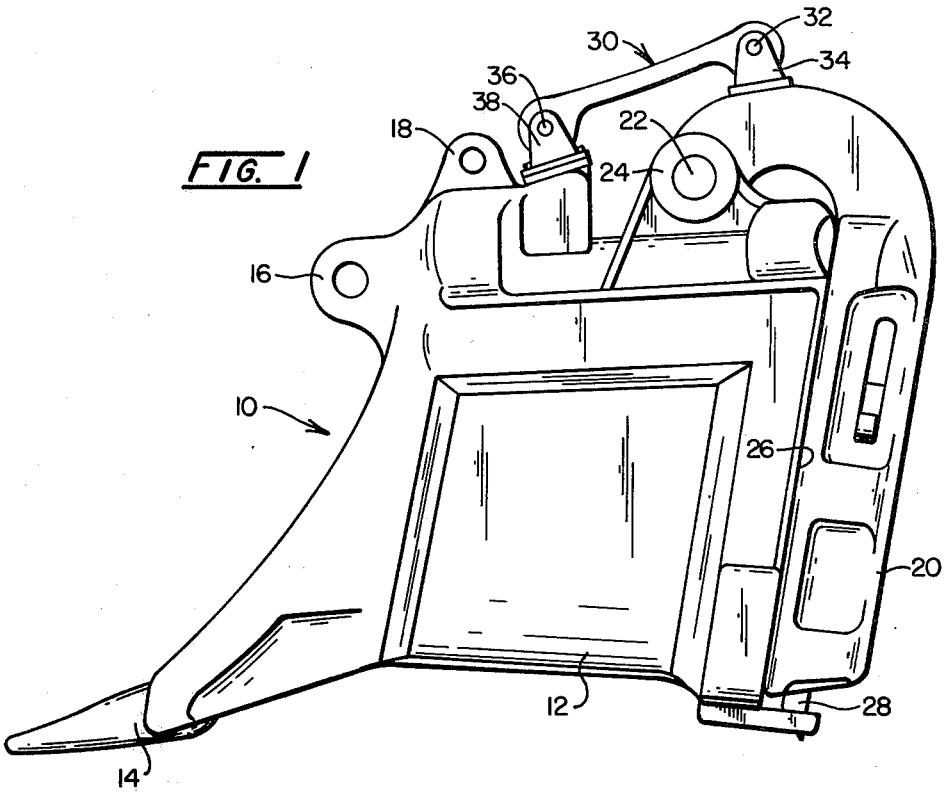
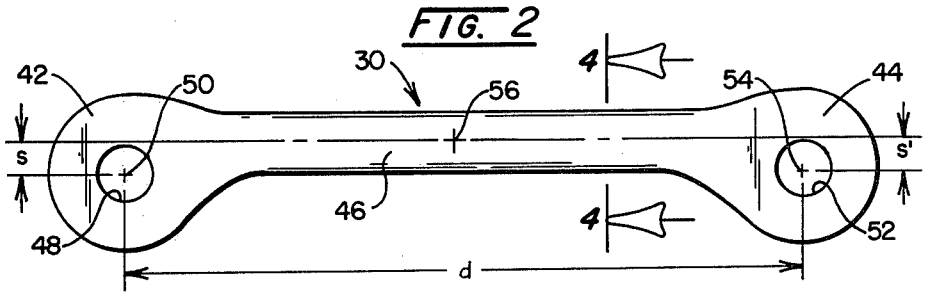
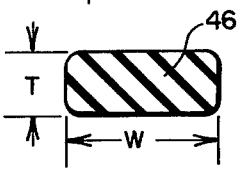
FIG. 4
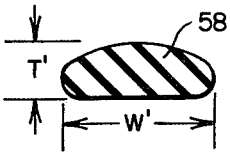
FIG. 5
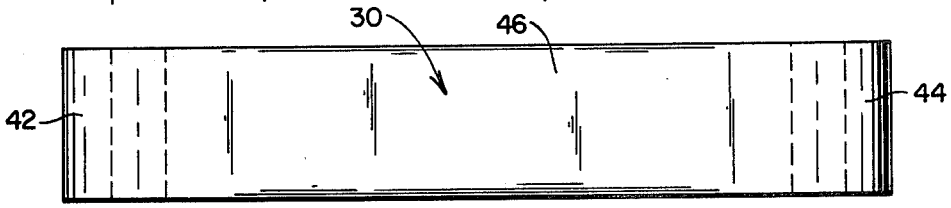
FIG. 3

SNUBBER HAVING UNITARY ELASTIC BODY

BACKGROUND OF THE INVENTION

1. Field of the Invention

This invention relates to snubbers and, more specifically, to a snubber for retarding movement of a door toward and away from an opening in a dipper.

2. Description of the Prior Art

When heavy objects are moved toward and away from each other, large inertia forces are created which must be counteracted to halt such movement. Such forces occur in large excavator dippers having heavy doors which open and close relative to discharge openings in the dippers. For example, a 15 cubic yard AMSCO® dipper has a door weighing 12,000 lbs. In operation, digging is begun with the door in a closed, substantially vertical position. When the bucket is full of mined rock, the dipper is rotated approximately 90°, elevated and moved to a discharge location, such as over a dump truck bed. The door is then opened, the mined rock is discharged, the bucket is again rotated 90° and the door closes.

If a 12,000 lb. door is opened and closed without any snubbing device, the door will slam into the bucket on closing and possibly into the handle on opening with such force as to damage the door, its hinge, the dipper or the handle. It was early recognized that some device to arrest or snub the extreme movements of the door is necessary.

In the past, snubbers have been developed for connection between the door and the dipper. These have taken the form of spring, friction or hydraulic snubbers. None of these has been found suitable in commercial use. Springs generally do not create sufficient force and can be fouled by rocks wedged between the coils. Hydraulic devices are extremely complicated and subject to such high pressures that they leak. Additionally, they are easily damaged by falling rock. Friction devices are most common in commercial usage, but are plagued by the necessity for constant adjustment due to rapid wear and cause much down-time because of a short useful life.

There exists a definite need for a device to snub the relative movement of heavy objects toward and away from each other, such as dipper doors, that has extended life, is relatively impervious to rock damage, is easy to install and provides sufficient snubbing forces.

SUMMARY OF THE INVENTION

We have found that a suitable snubber can be made from an elastomeric material, preferably urethane. This snubber is characterized by an elongated working section which interconnects a pair of end lugs having mounting holes. These mounting holes are offset from the longitudinal center line of the working section and are attached by pivot pins to the dipper and to the door. In a position intermediate the door closed and open positions, the snubber is in an unstressed condition, thereby facilitating installation and removal. As the door closes, the elastomeric working section is placed in tension to snub this movement. When the door is released and swings to open position, the working section is placed in bending to retard opening of the door.

Thus, a snubber is provided for use with a dipper having an opening and a door pivoted to the dipper for movement through an intermediate position between positions opening and closing the opening, and is characterized by the subber having a pair of end lugs interconnected by an elongated elastomeric working section, each end lug having mounting means for connecting the snubber between dipper and door so that the working section is subjected to tensile stress through door movement from the intermediate position to the closed position to retard door closing, is subjected to bending stress through door movement from the intermediate position to the open position to retard door opening, and is unstressed in the intermediate position.

A better understanding of this invention can be had by reference to the detailed description and the attached drawings wherein:

DESCRIPTION OF THE DRAWINGS

FIG. 1 is a side view of a dipper shown in digging position with the door closed and having a snubber according to this invention;

FIG. 2 is an enlarged side view of the snubber shown in FIG. 1, but shown unmounted;

FIG. 3 is a plan view of the snubber of FIG. 2;

FIG. 4 is a sectional view of the snubber working section, taken along lines 4—4 of FIG. 2;

FIG. 5 is a sectional view similar to FIG. 4, but showing a modified snubber working section;

DESCRIPTION OF THE PREFERRED EMBODIMENTS

Figure 6:
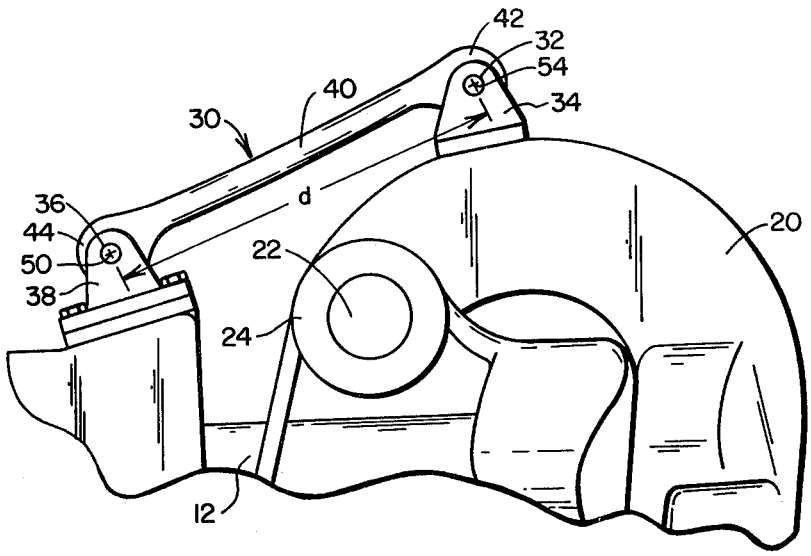
FIG. 6 is an enlarged fragmentary view of the dipper of FIG. 1 showing the snubber in tension in its door closed position.

FIG. 1 shows an excavator dipper assembly 10 which comprises a body 12 having digging teeth 14. A pair of front side bosses 16 (only one shown) are provided to pivotally attach the dipper to a conventional boom bail pivot pin, while a pair of bosses 18 (only one shown) are provided for pivotal attachment of the dipper to the excavator handle. A door 20 is located on the rear of body 12 and is pivotally attached by a pivot pin 22 to a boss 24 (only one shown) mounted on each side of the upper surface face of the dipper. As is conventional, door 20 is movable to open and close a rear dipper discharge opening 26. To maintain the door in closed position during digging operation, a latch bar 28 is provided. To open the door, a conventional remote operator (not shown) is actuated to retract the latch bar.

A pair of elastomeric snubbers 30 (only one shown) according to this invention are provided to retard opening and closing movement of door 20. Each snubber is attached at one end by pivot pin 32 carried by a door mounted bracket 34, and at its other end by a pivot pin 36 carried by a dipper mounted bracket 38.

Referring now to FIGS. 2 and 3, snubber 30 comprises an elongated working section 40 which interconnects a pair of end lugs 42 and 44. Working section 40 has an elongated center line designated 46. Lug 42 has a hole 48 for receiving one of the pivot pins. The center axis 50 of hole 48 is offset a distance S from center line 46. Similarly, lug 44 has a pivot pin hole 52 having its axis 54 offset a distance S' from center line 46. The working section 40 is of generally uniform, cross-section, as shown in FIG. 4, and, in one form of the invention, is generally rectangular, having a thickness T and a width W. Snubber 30 is preferably symmetrical about a plane perpendicular to center line 46 through working section midpoint 56. The symmetry enables the snubber to be installed with either lug connected to either mounting bracket.

FIG. 5 shows the cross-section of a modified working section 58 having a flat bottom and a convex top connected by round ends and having a width W' and a thickness T'.

In a specific application for the aforementioned AMSCO® 15 cubic yard bucket having a 12,000 lb. door, each of the two snubbers has a distance D between pivot axes of 46 inches, a width W of 10 inches and a thickness T of 3 inches. The snubber is a unitary urethane body weighing 90 lbs. The offset distances S and S' in this specific application are both $1\frac{1}{2}$ inches.

Figure 7:
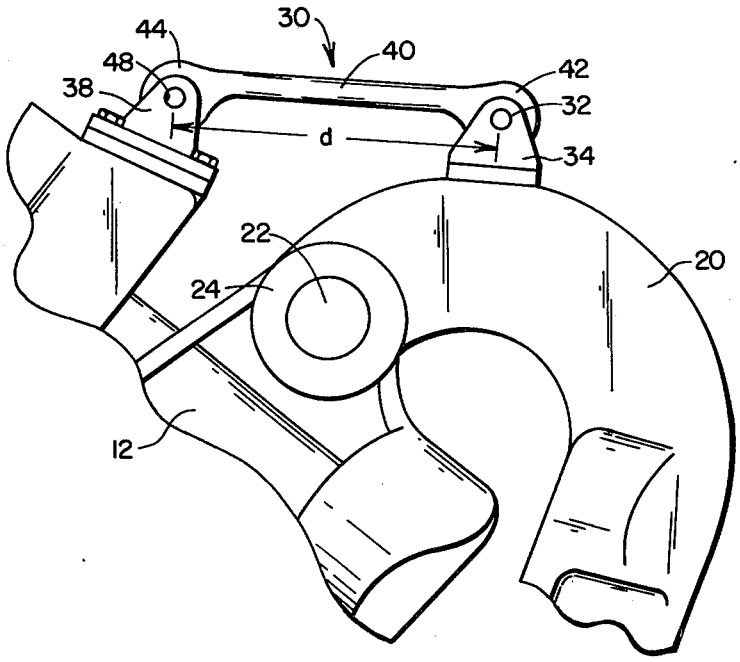
FIG. 7 is a view similar to FIG. 6 showing the snubber in its unstressed position.

The operation of the snubber will now be described. The unstressed condition of snubber 30 is shown in FIG. 7 with the door slightly open. In this position, it is a relatively simple matter to remove pivot pins 48 and 50 to remove and install a snubber.

Figure 8:
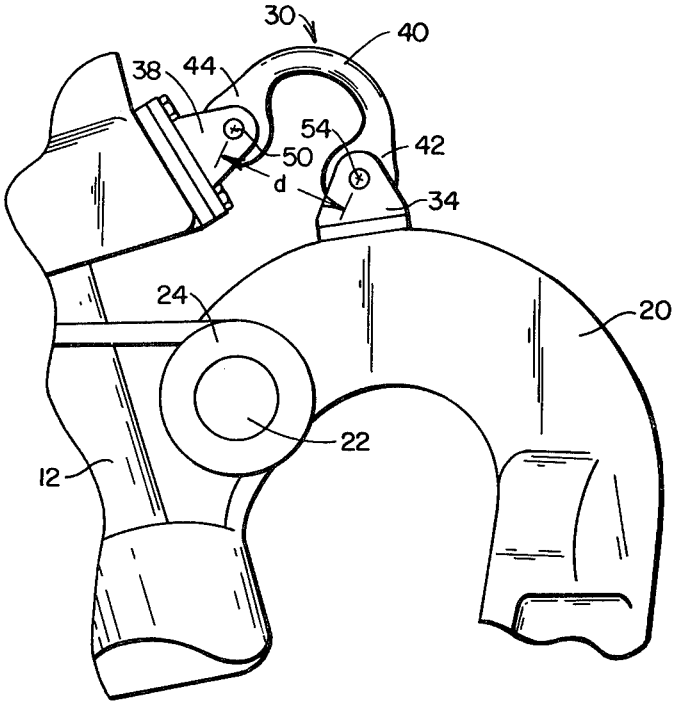
FIG. 8 is a view similar to FIGS. 6 and 7 showing the snubber in bending in its door open position.

To initiate the digging cycle, door 20 is closed, which stretches working section 40 to retard door closing. In the fully closed position of FIG. 6, distance D is increased 4 inches which places approximately a 12,000 lb. tensile load on each snubber. After the dipper 10 has been loaded with rock, the dipper is rotated approximately 90° and door 20 is opened. The inertia forces of the 12,000 lb. door opening under the force of gravity and the discharging rock snaps the door past the intermediate position of FIG. 7 to the position of FIG. 8. This movement forces pivot axes 50 and 54 toward each other and bends working section 40. Because pivot axes 50 and 54 are offset from center line 46 (FIG. 2), working section 40 bends outwardly. In the FIG. 8 position, each snubber 30 is subjected to approximately a 2500 lb. bending load to resist further opening movement of door 20. In this position, the distance D has been reduced to approximately 19 inches. To again close door 20, dipper 10 is rotated approximately 90° to the FIGS. 1 and 6 position. This causes snubber 30 to unbend and again stretch to snub door closing.

Because snubber 30 is elastomeric, any falling rock will merely bounce off it and cause no damage. As mentioned before, installation and removal is accomplished quickly and simply by removing pivot pins 32 and 36 when the snubber is unstressed, which occurs when dipper 10 is in the FIG. 7 position. With the unitary elastomeric snubber of this invention, there are no adjustments to make, no fluid to leak and no complicated installation.

While only a specific size snubber for a specific dipper application has been detailed, it is a simple matter to vary the dimensions to suit other specific applications. The effectiveness of this snubber is due to the snubbing effect achieved by placing the elastomeric material of the working section in tension on door closing and in bending on door opening, and by having an intermediate unstressed position to facilitate installation. Many obvious modifications can be made to the specific example shown without departing from the scope of our invention, such as varying the offset of the pivot axes, making the end lugs of a different material and providing different end lug mounting means.

We claim:

1. A snubber for use with a dipper which includes an opening and a door pivoted to the dipper for movement through an intermediate position between positions opening and closing the opening, characterized by the snubber having a pair of end lugs interconnected by an elongated elastomeric working section, each end lug having mounting means for connecting the snubber between the dipper and the door so that the working section is subjected to tensile stress during movement from the intermediate position to the closed position to retard door closing, is subjected to bending stress during door movement from the intermediate position to the open position to retard door opening, and is unstressed in the intermediate position, the snubber is a unitary elastomeric body in which the end lugs are integral with the working section, and the working section has a substantially uniform and generally rectangular cross-section and a thickness/width ratio of less than 1.

2. The snubber of claim 1, further characterized by the thickness/width ratio being less than 0.5.

3. The snubber of claim 2, further characterized by the thickness/width ratio being approximately 0.3.

4. The snubber of claim 1, further characterized by the working section having rounded corners to reduce stress concentrations.

5. A snubber for use with a dipper which includes an opening and a door pivoted to the dipper for movement through an intermediate position between positions opening and closing the opening, characterized by the snubber having a pair of end lugs interconnected by an elongated elastomeric working section, each end lug having mounting means for connecting the snubber between the dipper and the door so that the working section is subjected to tensile stress during door movement from the intermediate position to the closed position to retard door closing, is subjected to bending stress during door movement from the intermediate position to the open position to retard door opening, and is unstressed in the intermediate position, the snubber is a unitary elastomeric body in which the end lugs are integral with the working section, and the working section is generally uniform and has a cross-section characterized by a relatively flat bottom, a convex top and rounded ends.

* * * * *